United States Patent [19]

Vercelot

[11] 4,133,461

[45] Jan. 9, 1979

[54] HIGH-RELIABILITY VALVE

[75] Inventor: Jean P. Vercelot, Saint Maur, France

[73] Assignee: Aerosol Inventions and Development S.A. AID SA, Fribourg, Switzerland

[21] Appl. No.: 774,017

[22] Filed: Mar. 3, 1977

[30] Foreign Application Priority Data

Mar. 4, 1976 [FR] France ..... 76 06111
May 7, 1976 [FR] France ..... 76 13722

[51] Int. Cl.[2] ..... B65D 83/14
[52] U.S. Cl. ..... 222/402.24; 222/542
[58] Field of Search ..... 222/542, 402.24, 402.25, 222/402.1

[56] References Cited

U.S. PATENT DOCUMENTS 2,890,817 6/1959 Rheinstrom ..... 222/402.16
3,838,799 10/1974 Meuresch ..... 222/402.16

FOREIGN PATENT DOCUMENTS 1241195 7/1971 United Kingdom ..... 222/402.24

*Primary Examiner*—Robert B. Reeves
*Assistant Examiner*—Frederick R. Handren
*Attorney, Agent, or Firm*—Holman & Stern

[57] ABSTRACT

An aerosol container valve which achieves a high standard of reliability comprises a gasket placed around the valve stem and held in position between the valve cup and the valve housing. The gasket is maintained compressed between the cup and the housing at a number of point locations spaced at a distance from each other and from the central bore traversed by the valve stem, the point locations being spaced at intervals on a circumference which is coaxial with the central bore.

5 Claims, 4 Drawing Figures

HIGH-RELIABILITY VALVE

This invention relates to the pressurized packaging industry and is more especially concerned with valves for aerosol packs.

In aerosol dispenser valves of conventional design, leakage is sometimes found to develop for no apparent reason between the valve stem and the gasket which is fitted around the stem. It is noted that such leakage often occurs in the form of microleaks and is caused by ageing in the majority of cases.

When it is sought to determine the reasons for such leakage, it is generally found that this is due to a deformation of the central orifice of the gasket or to the fact that this orifice is slightly displaced off-center with respect to the general axis of the valve.

Broadly speaking, these deformations or displacements off-center can be ascribed to the high compression to which the gasket is subjected at the time of crimping of the valve housing within the valve cup.

The aim of the invention is to overcome the above-mentioned disadvantages of conventional valves.

Accordingly, the invention is directed to a valve for aerosol containers which achieves a high standard of reliability and comprises a gasket which is placed around the valve stem and held in position between the valve cup and the valve housing. The invention is distinguished by the fact that the gasket is maintained compressed between the valve cup and the valve housing at a number of point locations located at a distance from each other and also from the central bore which is traversed by the valve stem, said point locations being spaced at intervals on a circumference which is coaxial with said central bore.

In consequence, the gasket can accordingly be subjected to a sufficiently high value of compression to ensure leak-tightness and also to prevent rotational displacement of the valve housing within the valve cup.

The uniform distribution of the compression points permits of uniform and controlled distribution of expansion of the elastic material constituting the gasket in all directions around the compression points and not only in the direction of the central orifice and the periphery of the gasket as in conventional valves in which the gasket is compressed only in a continuous annular zone, thus giving rise to the danger of faulty centering of said zone in the axis of the valve.

It has been observed in addition that compression of of the gasket at point locations makes it possible to achieve a high standard of leak-tightness with overall values of compression of the gasket which are lower than those of conventional valves.

Compression of the gasket at point locations as thus contemplated permits rapid filling of the container which is fitted with the valve in accordance with the invention, the container being filled with propellants in either liquid or gaseous form ($CO^2$) by introducing these latter between the valve cup and the gasket. This proves to be the most rapid method of filling and avoids the need to introduce propellant through the dip tube of the container since this is unfavorable for packaging with gases such as $CO^2$.

A primary objective of the invention is to prevent undesirable puckering of the gasket between the ribs since this would be liable to impair the integrity of the seal between the gasket and the spring-holder cup or the valve stem in the vicinity of the bore of this latter. In consequence, the valve in accordance with the invention advantageously comprises a valve cup so designed that the internal face located opposite to the gasket is provided with a plurality of uniformly spaced radial ribs and with an axial orifice traversed by the valve stem, a uniform annular rib in coaxial relation to the bore of said valve stem being formed so as to project from said internal face between said bore and said radial ribs.

The annular rib provides the gasket with a flat bearing surface of small area around the bore of the valve cup in the immediate vicinity of the spring-holder cup or of the valve stem.

In accordance with an advantageous arrangement of the invention, the radial ribs and the annular rib have the same height.

A more complete understanding of the invention will be gained from the following detailed description and from the accompanying drawings in which three embodiments of the invention are illustrated by way of example but not in any limiting sense, and in which.

Figure 1:
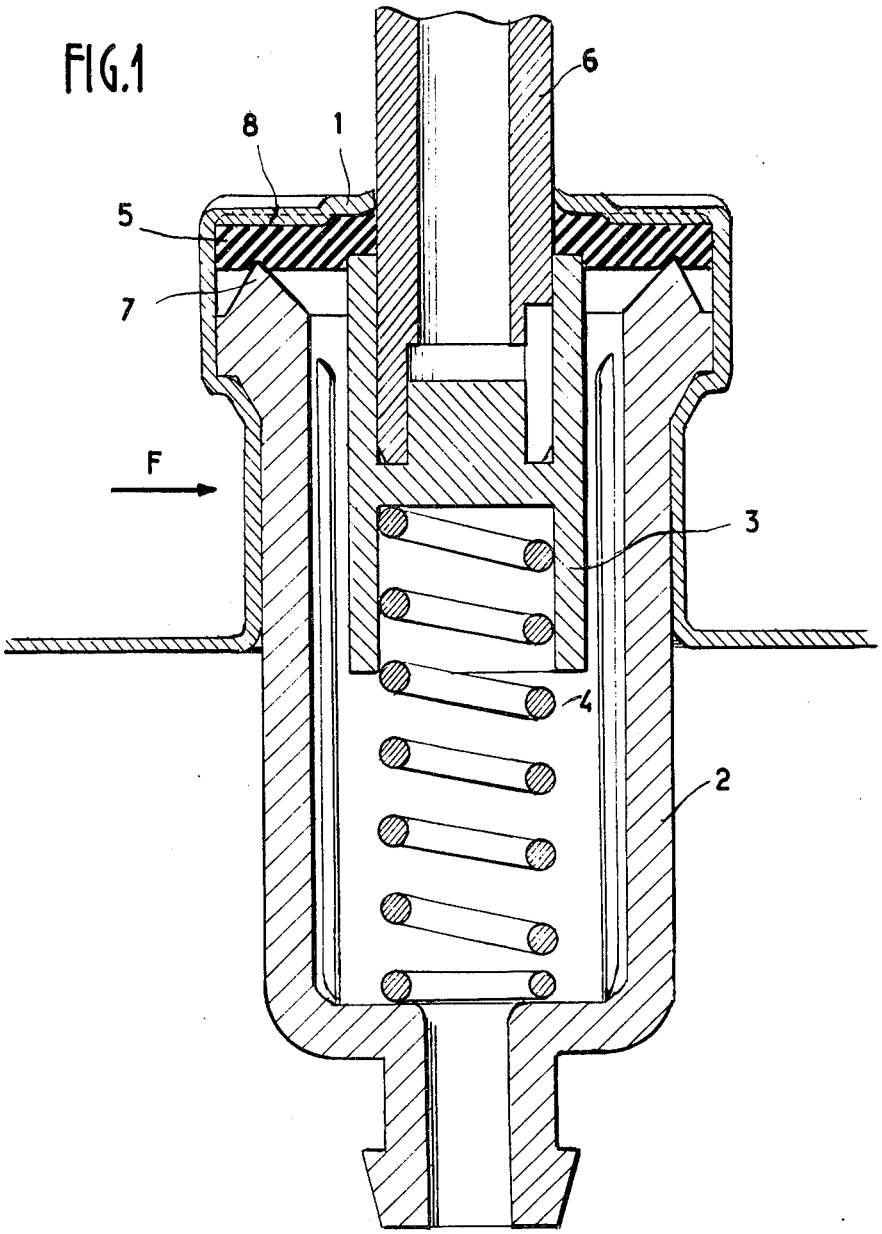
FIG. 1 is a fragmentary front sectional view of a first embodiment of a valve in accordance with the invention.
Figure 2:
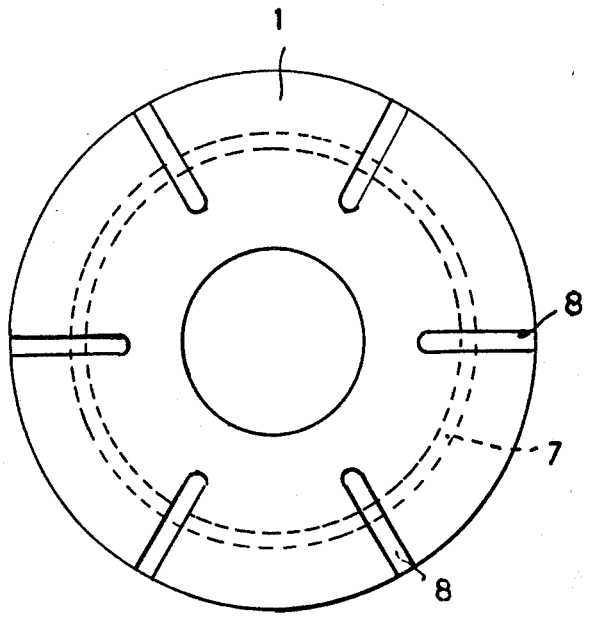
FIG. 2 is a top view only of the central portion of the valve cup shown in FIG. 1.

The valve in accordance with the embodiment which is illustrated in FIGS. 1 and 2 comprises a valve cup 1, a valve housing 2, a spring-holder cup 3, a spring 4 and a gasket 5 which surrounds the actuating stem 6 located externally of the valve.

The top edge 7 of the valve housing 2 has the shape of a wedge in transverse cross-section. This edge 7 is circular as shown in dashed lines in FIG. 2.

The top wall of the valve cup 1 is provided with ribs 8 opposite to the gasket 5.

On completion of the operation which consists in crimping the valve cup 1 onto the valve housing 2 as shown diagrammatically by the arrow F (FIG. 1) and during which the different elements are guided in the axial direction while preventing any undesirable stress on the gasket 5, said gasket 5 is compressed at the point of intersection of each wedge-shaped surface constituted by a wedge-shaped rib 8 of the valve cup 1 with the wedge-shaped surface of the continuous top edge 7 of the valve housing 2.

By way of alternative, the wedge-shaped surfaces which intersect in pairs and serve to compress and hold the gasket in position can be designed in the form of a circular rib carried by the valve housing (as in the embodiment of FIG. 1) and in the form of a broken-line rib carried by the valve cup (or the reverse arrangement).

Figure 3:
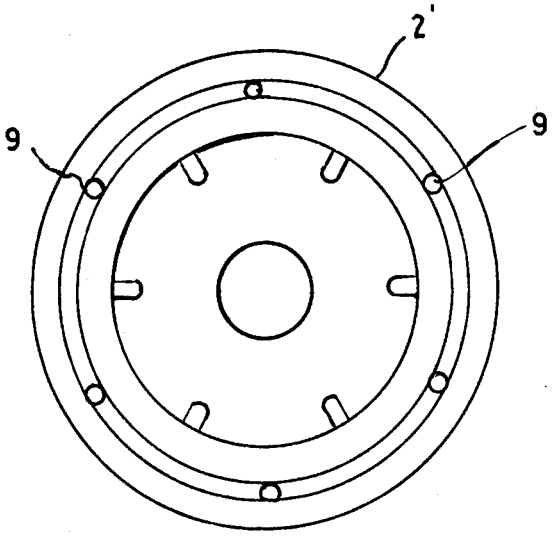
FIG. 3 is a top view of a valve cup in a second embodiment of a valve in accordance with the invention.

In another embodiment which is illustrated in FIG. 3, the gasket is applied against the opposite face of the valve cup which has been allowed to remain smooth by means of a plurality of uniformly spaced conical studs 9 which project from the top edge of the valve housing 2' (this latter being otherwise identical with the housing shown in FIG. 1).

Figure 4:
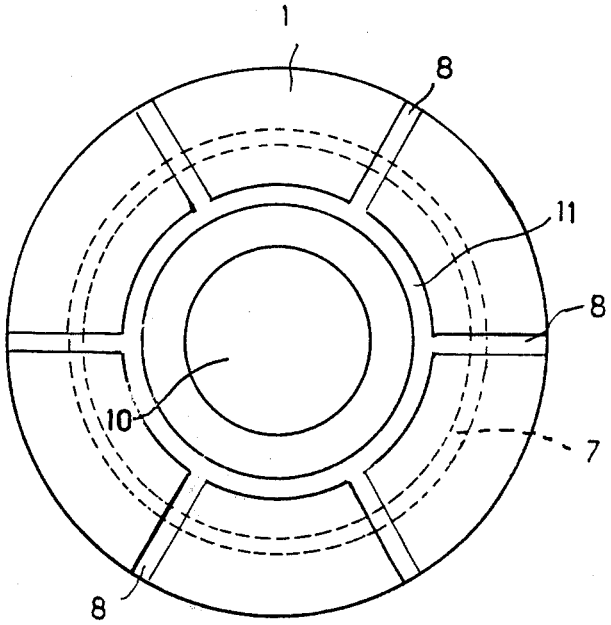
FIG. 4 is a top view only of the central portion of the valve cup in accordance with the invention.

In another embodiment which is illustrated in FIG. 4, the valve cup 1 is provided around its central bore 10 with six radial ribs 8 in uniformly spaced relation. Said radial ribs extend inwards to their point of intersection with an annular rib 11 which is coaxial with the valve cup 1.

The annular ribs 11 and radial ribs 8 have the same height.

In FIG. 4, there is shown in dashed lines 7 the top edge of the valve housing in which the radial ribs 8 compress the gasket at a number of point locations.

As can readily be understood, the invention is not limited in any sense to the embodiments described in the foregoing and illustrated in the accompanying drawings. Depending on the applications which are contemplated, many alternative forms which are within the capacity of anyone versed in the art can be devised without thereby departing either from the scope or the spirit of the invention.

Thus it follows that, as an alternative to the embodiment shown in FIG. 1, the bottom face of the valve cup 1 could have an annular wedge-shaped rib which is similar to the top edge 7 whilst ribs such as 8 could project from the top portion of the valve housing 2 instead of the valve cup 1.

Similarly, the conical studs 9 shown in FIG. 3 could be carried by the valve cup 1, in which case the top edge of the valve housing is flat and smooth or is preferably provided with a continuous wedge-shaped edge which is similar to the edge 7 of the valve housing of FIG. 1 in oppositely-facing relation to the conical studs 9.

I claim:

1. An aerosol valve construction including a valve housing, a valve cup in which an upper part of said housing is located, a gasket within said cup between an upper end of said valve housing and a top wall of said cup, means defining a central bore through said gasket and said top wall for a valve-actuating stem and means for compressing said gasket between said upper end of said valve housing and said top wall of said cup at a series of point locations substantially uniformly spaced on a circumference coaxial with said central bore, said compressing means comprising a first wedge-shaped surface on said upper end of said housing and a complementary second wedge-shaped surface on the interior of said top wall of said cup, the respective wedge-shaped surfaces, when viewed axially of said bore, having points of intersection defining said point locations.

2. The valve construction of claim 1 wherein said complementary second wedge-shaped surface on the interior of said top wall of said cup comprises a plurality of substantially uniformly spaced radially extending ribs.

3. The valve construction of claim 2 including an annular rib on the interior of said top wall of said cup between said bore and said radially extending ribs.

4. The valve construction of claim 3 wherein said radially extending ribs and said annular rib are of substantially equal height.

5. The valve construction of claim 2 wherein said housing comprises an annular wedge-shaped upper end defining said first wedge-shaped surface.

* * * * *